US005505659A

United States Patent [19]

Hamilton

[11] Patent Number: 5,505,659

[45] Date of Patent: Apr. 9, 1996

[54] VENTILATION DEVICE

[75] Inventor: John George Hamilton, Edinburgh, Scotland

[73] Assignee: Product Design & Innovation Limited, Edinburgh, Scotland

[21] Appl. No.: 232,150

[22] PCT Filed: Nov. 6, 1992

[86] PCT No.: PCT/GB92/02051

§ 371 Date: Jul. 25, 1994

§ 102(e) Date: Jul. 25, 1994

[87] PCT Pub. No.: WO93/09327

PCT Pub. Date: May 13, 1993

[30] Foreign Application Priority Data

Nov. 6, 1991 [GB] United Kingdom ..... 9123554

[51] Int. Cl.[6] ..... E06B 7/082

[52] U.S. Cl. ..... 454/213; 454/274

[58] Field of Search ..... 454/196, 211, 454/213, 214, 271, 273, 274

[56] References Cited

U.S. PATENT DOCUMENTS

| | | | |
|---|---|---|---|
| 1,785,263 | 12/1930 | Jensen | 454/274 |
| 4,736,677 | 4/1988 | Smith | 454/213 |
| 5,137,492 | 8/1992 | Archer et al. | 454/213 |

FOREIGN PATENT DOCUMENTS

| | | | |
|---|---|---|---|
| 252130 | 5/1963 | Australia | 454/213 |
| 0073273 | 3/1983 | European Pat. Off. . | |
| 1934996 | 1/1971 | Germany | 454/213 |
| 2607937 | 9/1977 | Germany . | |
| 3305028 | 8/1984 | Germany | 454/213 |
| 2213856 | 8/1989 | United Kingdom | 454/214 |

*Primary Examiner*—Harold Joyce
*Attorney, Agent, or Firm*—Popham, Haik, Schnobrich & Kaufman, Ltd.

[57] ABSTRACT

A ventilation device is provided for location at the outer edge of a window frame and comprises side members defining inlet and outlet portions. The members provide opposing sockets to receive plates completing a closed duct in the device for air flow, the width of this device being varied by providing plates of different width. The ends of the duct include closure assemblies, and the side members preferably comprise exactly similar structures. Weather members are fitted to the side members by releasable fastening means. In an alternative embodiment, the side members are dissimilar, one integrally carrying the plates while the other includes the socket for the plates.

25 Claims, 12 Drawing Sheets

VENTILATION DEVICE

The present invention relates no a ventilation device.

It is the maim object of the present invention to provide a versatile ventilation device for fitting on windows and the like.

According to the present invention a ventilation device for use at windows and the like, comprises a main duct body adapted for throughflow of ventilating air, said body comprising a plurality of parts certain of which are adapted to permit variation in the width of the device.

Preferably =he parts interfit so that when the ventilation device is assembled the device has structural integrity.

Preferably means are provided for connecting said parts to enable said width variation of the device, and preferably said width variation means Comprises a male-female interconnection.

In a preferred embodiment the ventilation device comprises inlet and outlet portions, and the plane means connecting said portions, width variation of the device being achieved via said plate means. The inlet and outlet portions may be similar, essentially representing minor images of each other, and the device can be symmetrical above a mid-plane.

Preferably at least one of the inlet and outlet portions includes an outer weather member, means being provided to releasably connect said member into said one portion.

Preferably the ends of the main duct body are closed by closure assemblies which are adapted for compatibility with main duct bodies of varying width.

Figure 1:
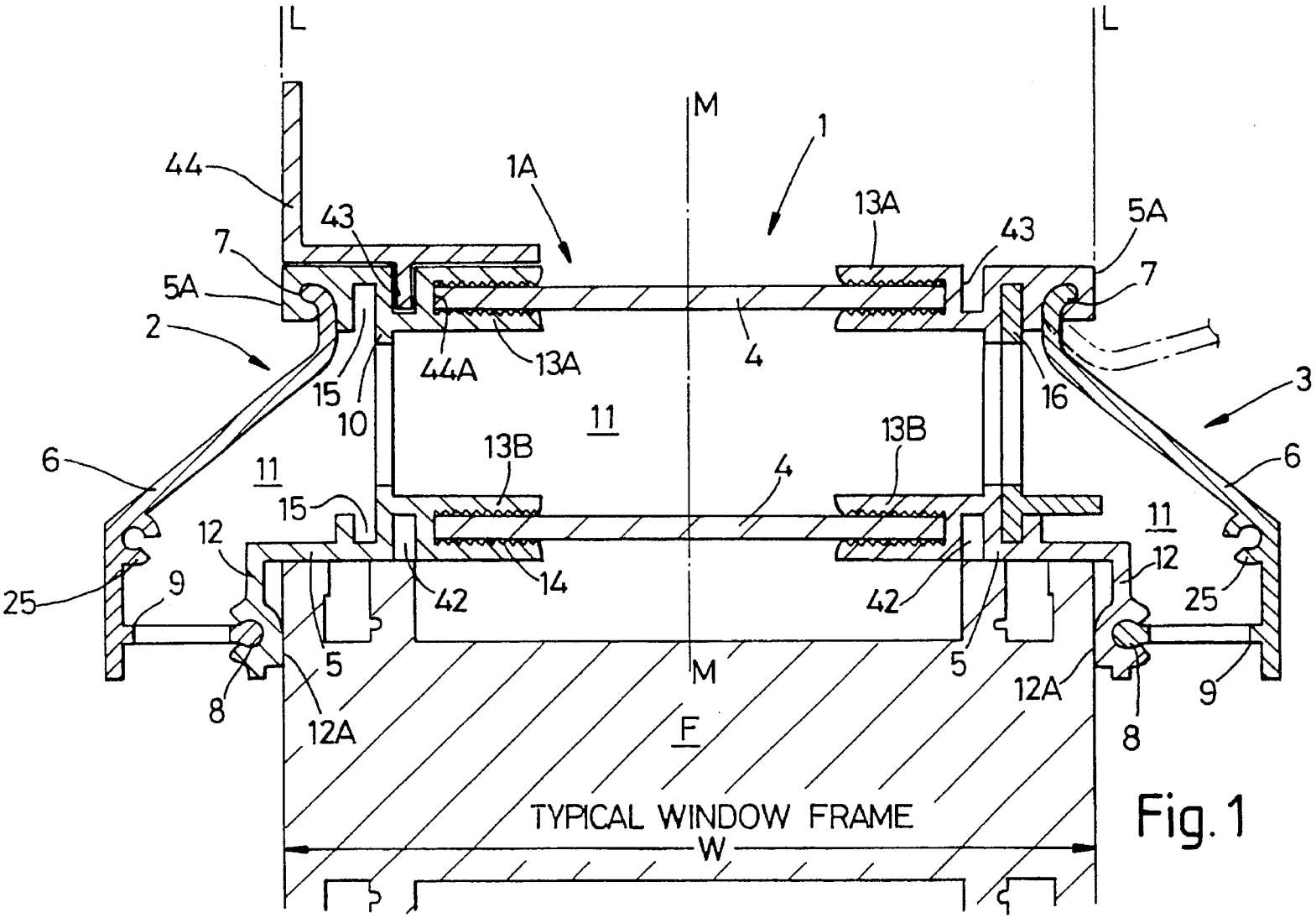
Figure 2:
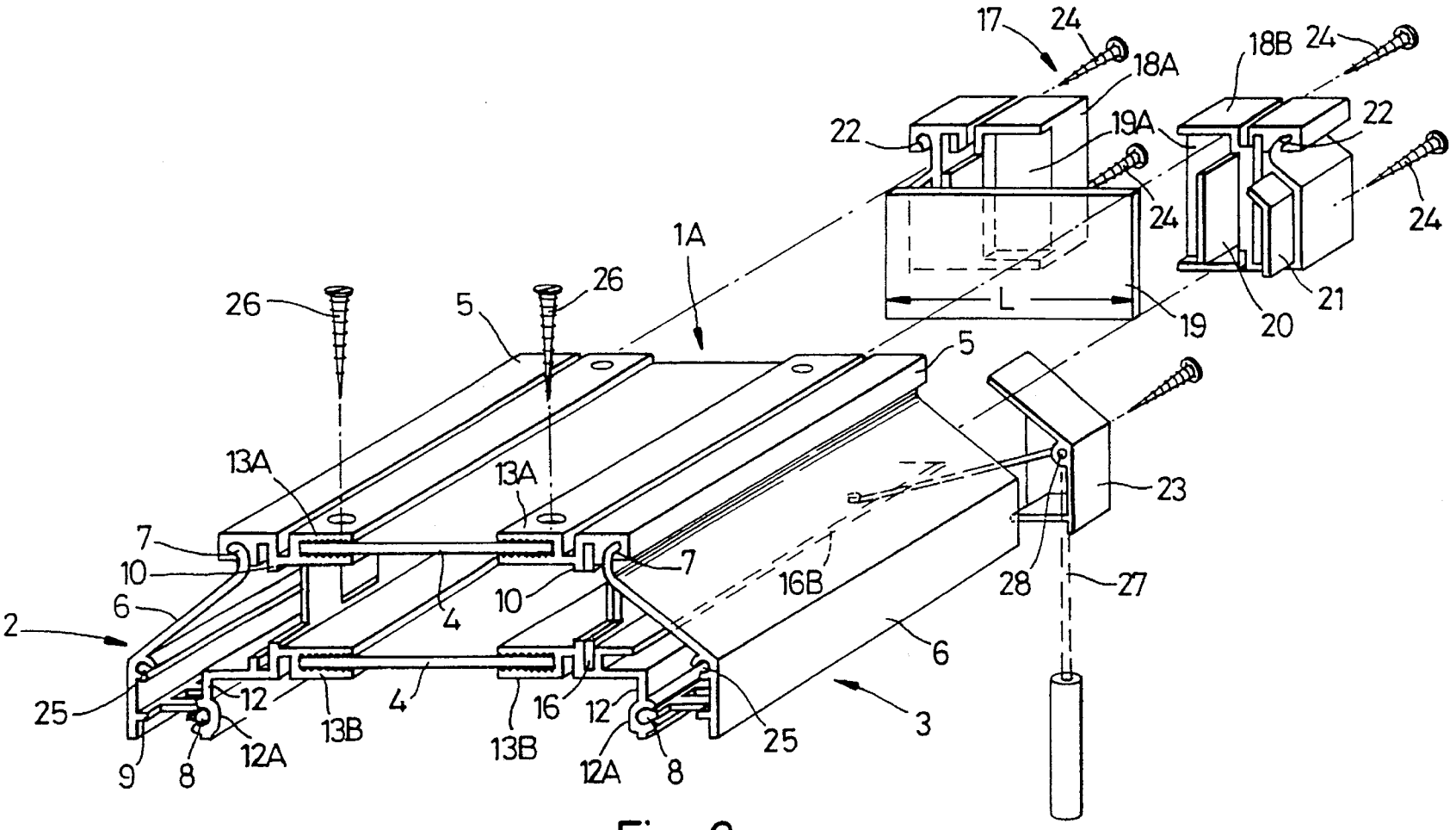
Figure 3:
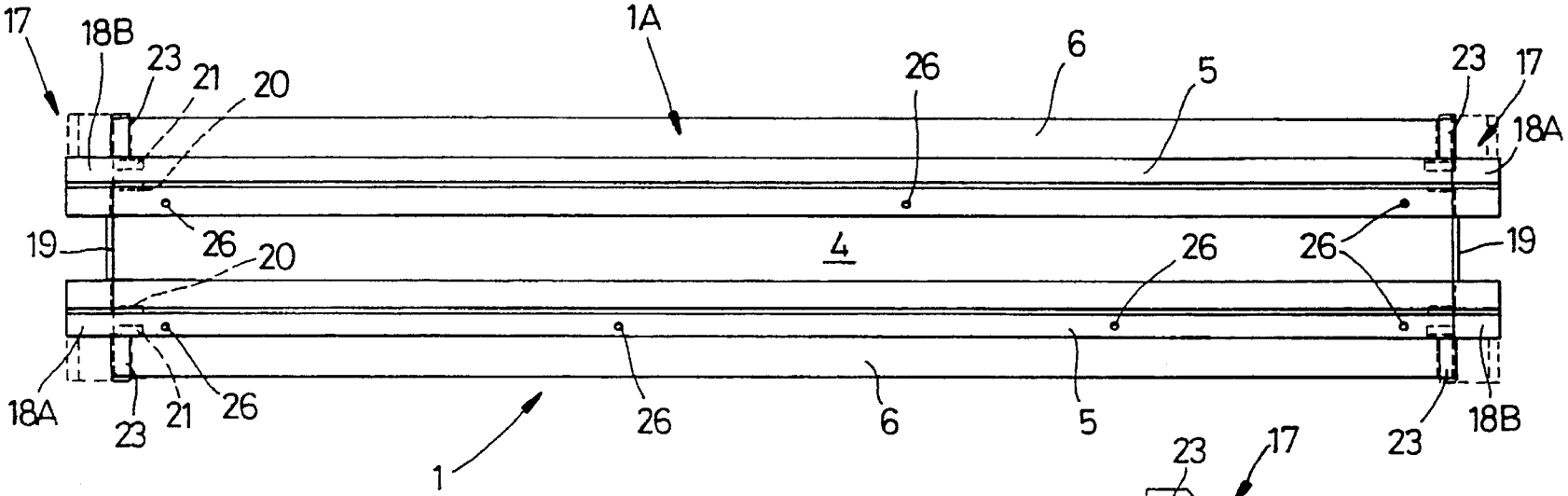
Figure 4:
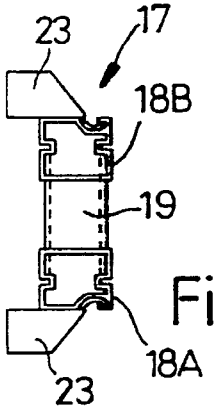
Figure 5:
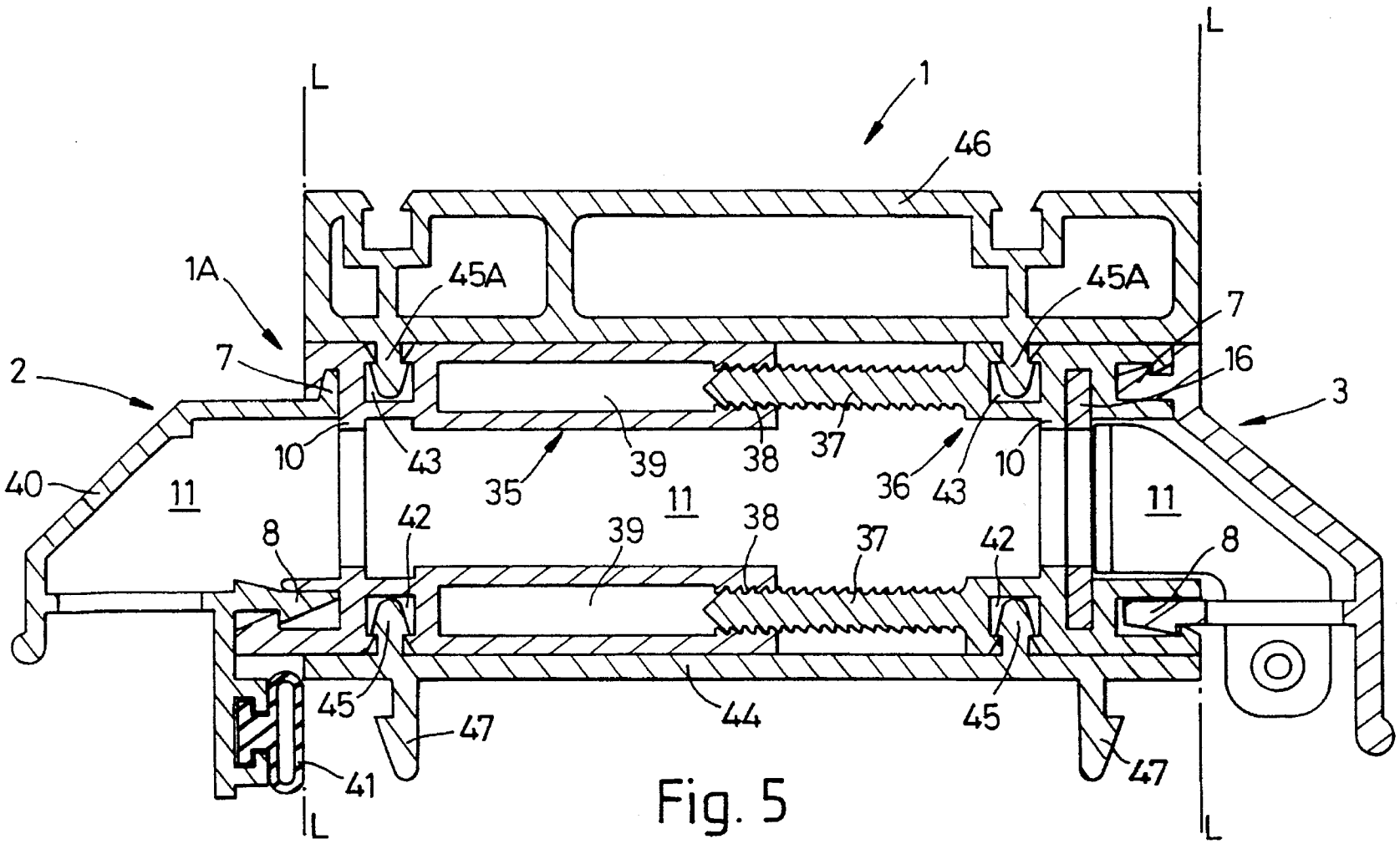
Figure 6:
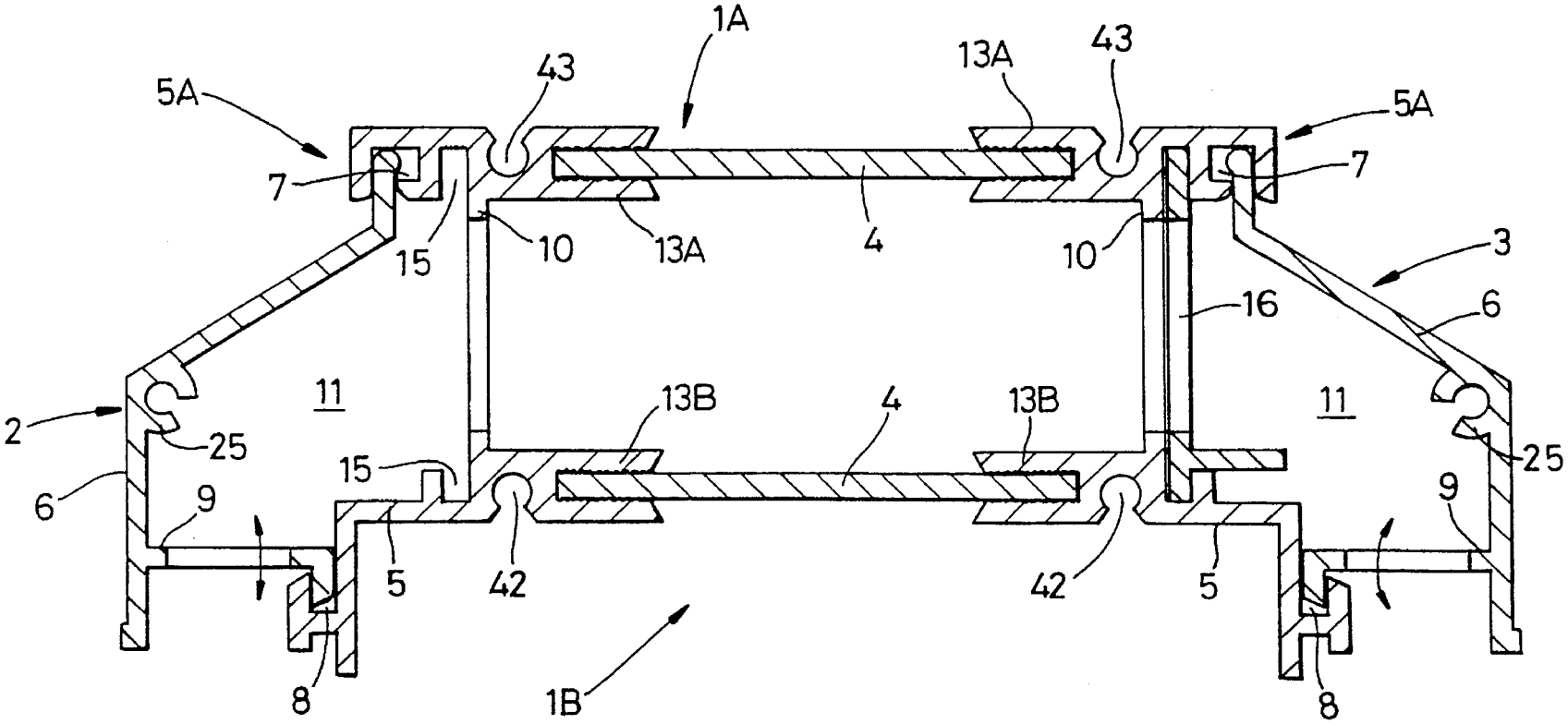
Figure 7:
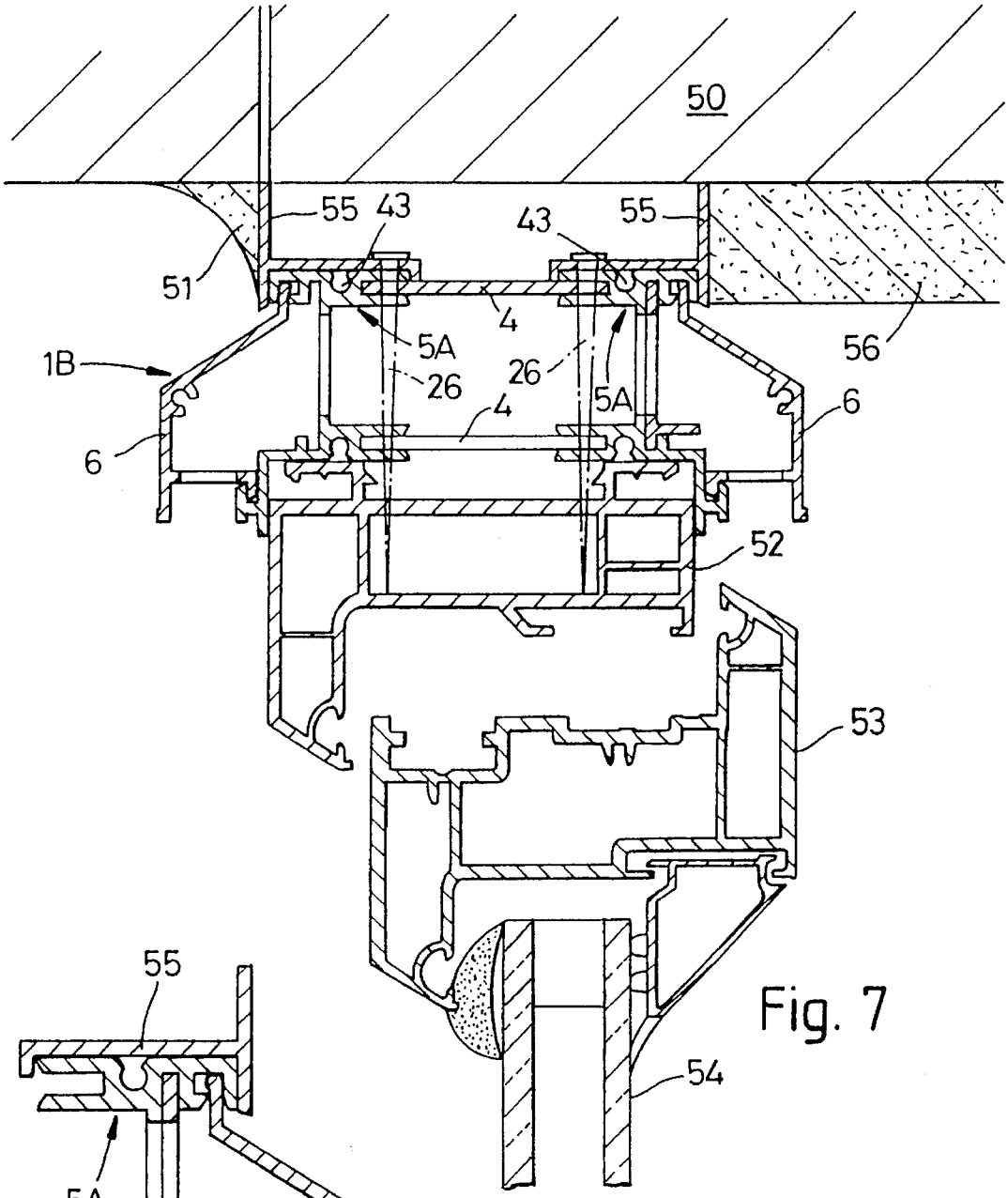
Figure 7A:
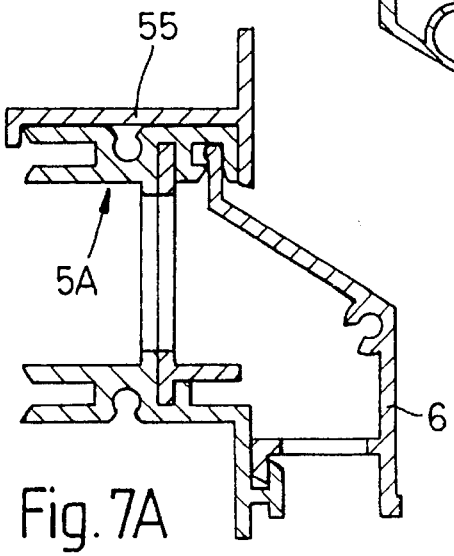
Figure 8:
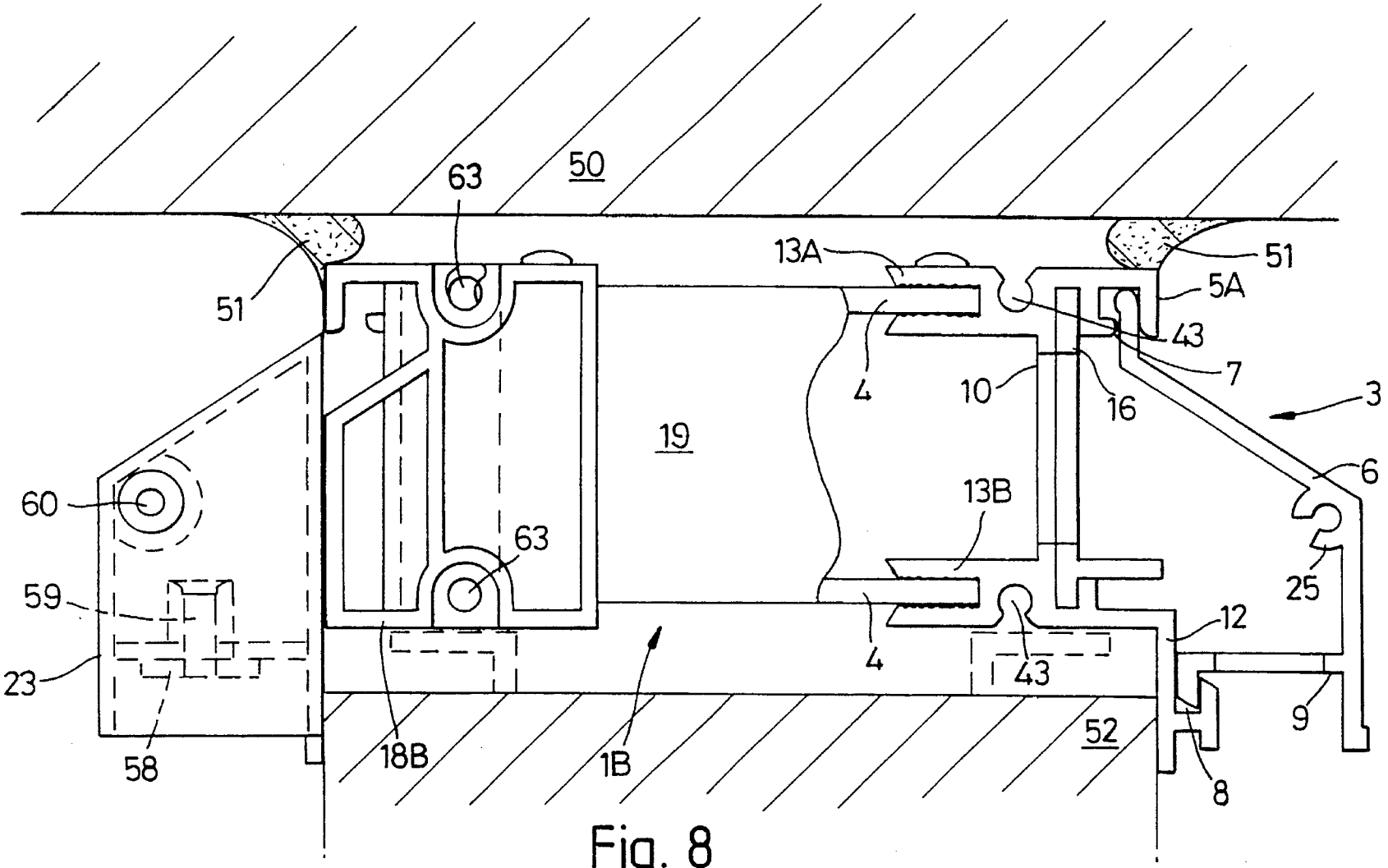
Figure 9:
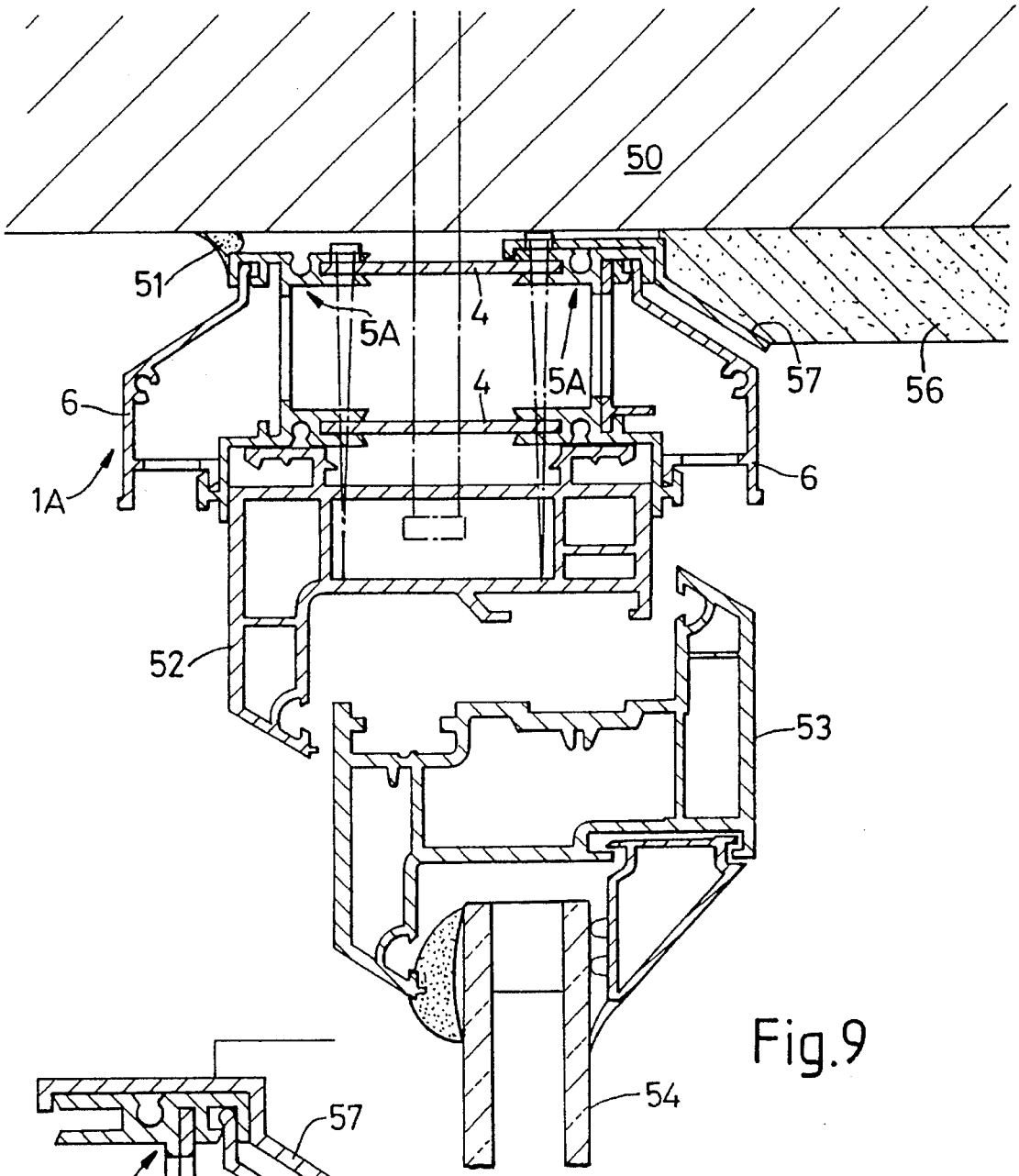
Figure 9A:
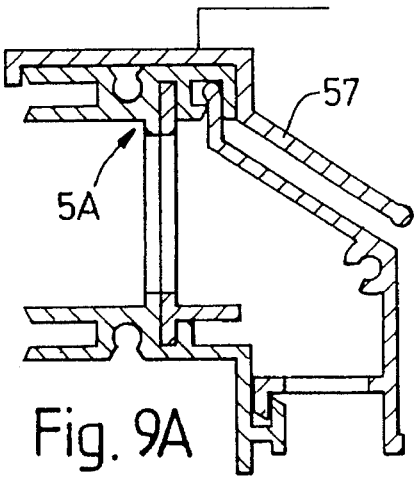
Figure 10:
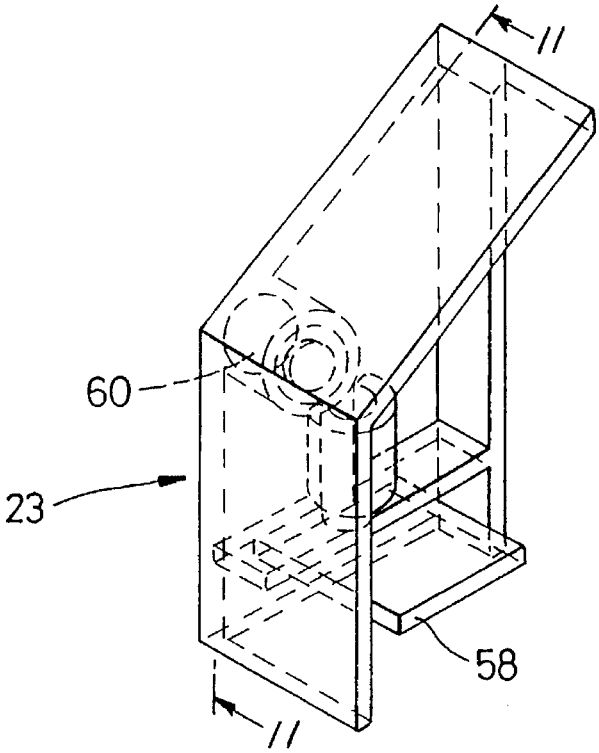
Figure 11:
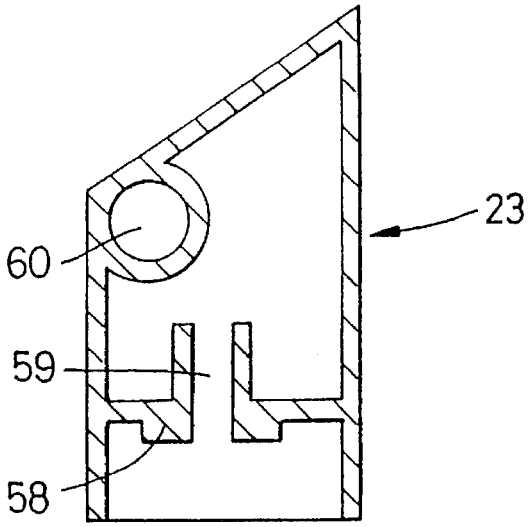
Figure 12:
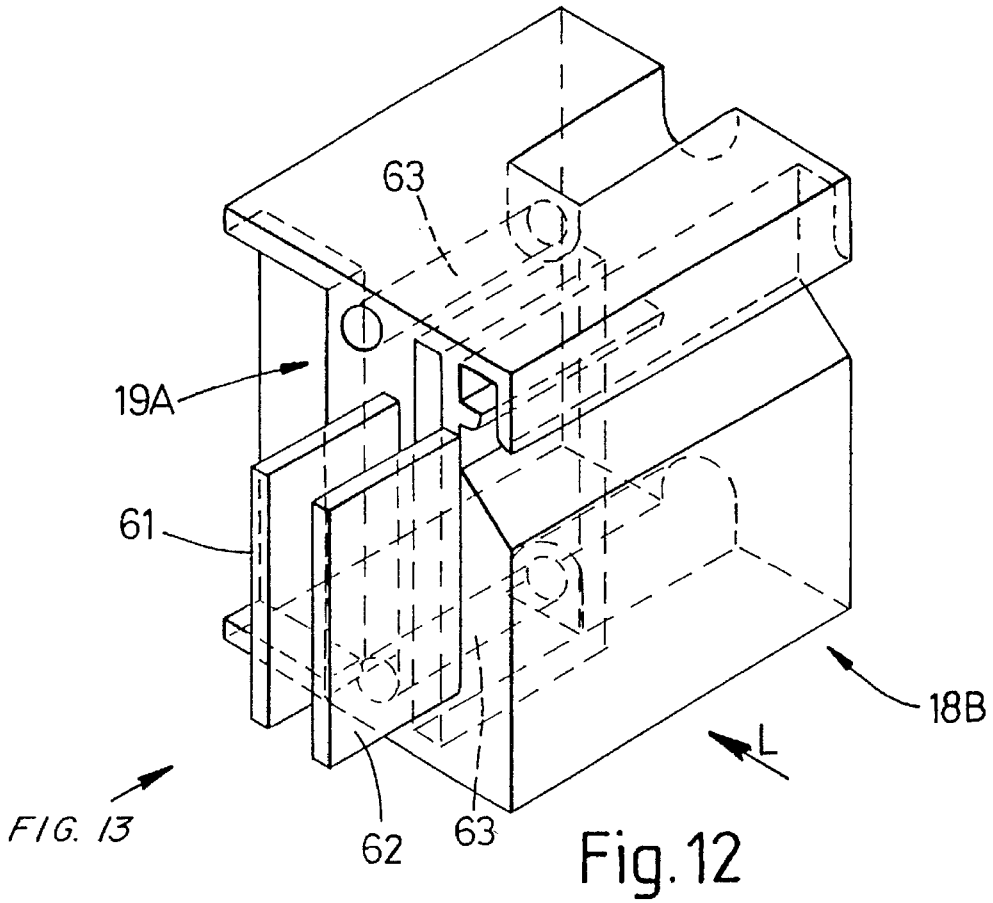
Figure 13:
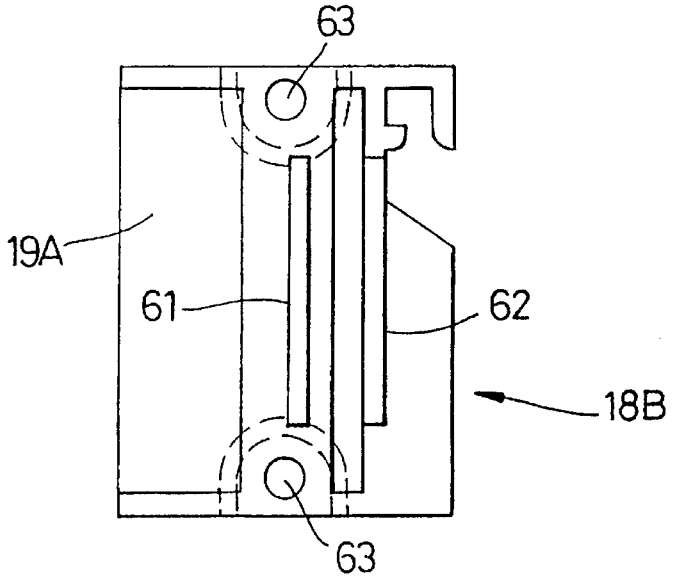

Embodiments of the present invention will now be described by way of example with reference to the accompanying drawings wherein:

FIG. 1 shows a cross-sectional elevation of a ventilation device according to one embodiment of the present invention;

FIG. 2 shows a pictorial "exploded" view of the ventilation device, while FIG. 3 shows a plan view and FIG. 4 an end view; and FIG. 5 shows a cross-sectional elevation of a ventilation device according to a second embodiment of the invention. FIG. 6 shows a part cross-sectional elevation of a ventilation device Similar to that of FIG. 1 but with modifications, FIGS. 7, 8 and 9 show side views of the ventilation device of FIG. 6 as applied in various window applications; FIG. 8 showing parts of the end cap; FIGS. 7A and 9A show end views of detail trims used in the FIGS. 7, 8 and 9 applications; FIG. 10 shows a pictorial view of a nose cap as used in the ventilation device of FIG. 6 while FIG. 11 shows the section 11—11 of FIG. 10; FIG. 12 shows a pictorial view of a closure plug used in the FIG. 6 device while FIG. 13 shows a view in the direction of the arrow labeled FIG. 13 in FIG. 12; and FIGS. 14A– 14E show several further modifications.

Referring to FIGS. 1 to 4, a ventilation device 1 for fitting as a separate and individual item at the outer edge of a window frame F comprises a main duct body 1A including a first, inlet, body portion 2; a second, outlet, body portion 3; and plane members 4 joining the body portions 3, and the arrangement of the vent device 1 is such as to permit the device 1 to cater conveniently for different widths W of the frames F.

As can be seen in FIG. 1, the body portions 2, 3 are exactly similar, the device 1 in fact being symmetrical about a mis-vertical plane M—M, and this provides substantial economies in the manufacture of the device 1, especially as fewer extrusion tools are required. Additionally, the ventilation device 1 is simple to assemble and this provides further economies.

Each body portion 2, 3 comprises a main support part and a weather part 6 connected to the part 5 by male-female connections 7, 8, the support parts 5 being adapted to rest on the frame F while the connection 8 can be of snap fit type to permit easy release of the part 6. The weather part 6 includes a lateral wall 9, carrying the male element of the connection 8, and apertured to permit airflow and the body part 5 also includes an apertured wall 10 thereby providing a conduit 11 for exterior to interior (or vice versa) airflow across the top of the frame F. Additionally, the part 5 includes a downwardly extending wall 12 providing a seal formation 12A or sealing engagement with a side surface of the frame F.

For the provision of width adjustment in the device 1 each body part 5 carries spaced-parallel socket connectors 13A, 13B to receive the plates 4 in male-female interconnection. To provide a certain securment of the plates 4, in the parts 5, the interior of the socket connectors 13A, 13B are of an appropriate serrated or toothed configuration 14 to grip the plates 4 and thereby mitigate against outward return movement of the plates. The width of the ventilation device i can be varied simply by utilizing plates 4 of different widths, and the socket connectors 13A, 13B have sufficient depth co ensure structural integrity of the fully assembled device 1 for convenient lifting and placement of the device 1 on window frame F substantially in the manner described in the applicants U.K. Patent Specification 2194038. Opposed grooves 15 in the body part 5 serve to receive an air-control slider plate 16 (only in the outlet portion 3 in this example) having apertures corresponding to those of wall 10.

Referring to FIGS. I and 3, closure assemblies 17 are provided for closing the ends of the main duct body 1A and comprise right and left hand plugs 18A, 18B received in the ends of the body parts 5/6. A closure plate 19 located in recesses 19A in the plugs extends between the plugs 18A/B and the plate 19 is selected to have a length L such that the assemblies 17 can be compatible with bodies 1A of different width: in particular the plate(s) 19 can comprise simply transverse cut portions from strips of material which have been cut to the desired width for the provision of the plates 4 - this ensures complete size compatibility. Each plug 18A/B includes lugs 20, 21 to overlap with the associated parts 5 and 6, a groove 22 in the plugs receiving the male connecting element 7 of the weather part 6 while nose caps 33 co-operate with the parts 6 to complete end closure. The assemblies 17 are secured to the main body 1A by screws 24 engaging with formations 25 on the part 6 and with the portions 13A. The ventilation device 1 is fixed to the frame F by means of screws 26 extending through the portions 13A/B and the plates 4 to be engageable with the frame F. The caps 23 are set inwardly in FIG. 3 but They could be located at the full length of the device 1 (as shown dashed).

The caps 23 serve to support a cord portion 27, for example by means of eye 28, of a cord control for the slider plate 16, an end of the cord portion 27 being attached to a lateral lug 16B of the plate 16, while a cord portion 27 is associated with each cap 23 at the outlet portion 3 for reciprocating movement of the slide plate 16.

The parts of the ventilation device 1 can be made from any suitable material, but it is particularly preferred that the inlet and outlet portions 2, 3 are of metal, e.g. aluminium extrusions for improved weathering properties, while the plates 4 are of plastics material to peclude cold bridging between the portions 2, 3. The use of metal for the portions 2, 3 will provide added strength, and the metal can be of a colour meeting requirements. A further advantageous feature is that the weather parts 6 can be swung back (as shown dashed in FIG. 1) with the connection 8 freed, to permit internal cleaning of the device or for access to possible infil material such as, for example, an acoustic cartridge.

A significant feature of the ventilation device 1 of FIGS. 1–4 is that the outer edge 5A of the body part 5 lies on a line L co-linear with the sealing formation 12A. This ensures that the width of the device 1 does not exceed the width (W) of the frame F apart from small inlet and outlet portions including weather part 6, the significance of this feature being that it can avoid disruption to internal plaster finishes in replacement window situations where a window with a device 1 fitted replaces a conventional window and also allows the device to be used in screen or curtain wall arrangements where additionally there my be a window/glazed panel above the device 1.

It is possible for the socket connectors 13A/B themselves to provide a certain width adjustment, and in the embodiment shown in FIG. 5 the plates 4 are dispensed with and the portions 2, 3 are directly connected. The main body 1A of the ventilation device of FIG. 5 comprises separate portions 35, 36 which are joined by means of barbed tongues 37 on portion 36 engaging in apertures 38 in the other portion 35 which apertures are complementary serrated with respect to the tongue barbs whereby the width W of the duct body 1A can be varied, the portion 35 including recesses 39 to receive the tongues 37 in the fully retracted condition 1A the body 1A. The exterior weather part 40 carries a seal 41 for engaging with the window frame. Consequently, the ventilation device i can be easily adjusted to be a precise fit on any window having a width (or depth) within a particular range compatible with the adjustment range of the body IA e.g. 50 mm to 70 mm.

The ventilator device of FIG. 5 could be fitted directly to a window or other structure generally as per FIG. 1, the ends of the device again being closed by suitable caps (not shown). However, the device 1 of FIG. 5 could be installed by means of special adaptor fittings as an alternative. Thus pairs of grooves 42 and 43 are provided to enable the fitting of an adaptor plate 44 via tongues 45 and a top fitting 46 via tongues 45A. As will be seen the adjustable body 1A caters for different spacings of the tongue pairs 45 and 45A. If preferred the body 1A can be set permanently at a particular width for example by applying adhesive between the apertures 38 and the tongues 37. Adaptor plate 44 includes tongues 47 to facilitate fitting to grooves in the outer edge of a window frame.

The device 1 of FIGS. 1–4 could be fitted in a similar manner, to this end gooves 42, 43 being provided to receive tongues for location and/or securement of the device 1, again by means of special adaptor fittings as appropriate. FIG. 1 shows the provision of an adaptor in e form of a simple angle 44 fitted to the body 1A at a groove 43 by means of a lip 44A on the angle.

It will be toted that the width of the ventilaion device 1 of FIG. 5 lies within the lines L definin the width of the frame, similarly as in the FIGS. 1–4 embodiment.

The ventilator device 1B of FIG. 6 is closely similar to the ventilation device 1 of FIGS. 1–4 but with minor differences. Thus the male-female connections 7, 8 differ from those of FIG. 1: the weather part (canopy) 6 is now fitted by firstly making the connection then pushing the part 6, inwards against the wall 6 thereby causing the lateral wall 9 to deflect enabling the male-female connection 8, to spring together. The downstand 12 now of plain form, and recesses 43 are generally of the form shown in FIG. 5 for snap-fitting of components. The device 2B is shown installed in a basic manner in FIG. 8 with plaster finishing 51 between the device 1B and the surrounds 50. Also the left side nose cap 23 and closure plug 18B are indicated as is the closure plate FIG. 7 shows the device 1B secured at the outer edge of an extruded window frame 52 e.g. of plastics or aluminium material, the frame 52 supporting a swinging or tilting window comprising an extruded sash pare 53 and a glazing unit 54. Further, simple angle trim 55 are fitted on the top of the device 1B to facilitate finish plastering 52, 56. It would be possible to utilise only a single angle trim at one side and have the other side without trim as shown in FIG. 8. FIG. 9 uses yet another style of simple trim 57. The trims could be provided with detents for snap fitting in the recesses 43.

FIGS. 10 and 11 illustrate the nose cap 23 fitted the ends of the weathering strip (canopy) 6 in FIG. 6. The cap 23 includes a tongue 58 for location under the lateral plane 9, a guide 59 for the cord portion 27 (where fitted) and an aperture 60 for a securing screw which engages the formation 25. Mirror image left and right hand caps 23 will of course be provided. FIGS. 12 and 13 show an end plug 18B for the FIG. 6 device: this is generally similar to the plug shown in FIG. 2 and the plugs are interchangeable. In this case the plug 18B (18A), carries tongue plates 61, 62 which embrace the side-by-side located wall 10 and plate 16, when the plug is fitted, apertures 63 in the plug receiving screws 24 which are fitted at recesses 43 for locating the plug.

Figure 14A:
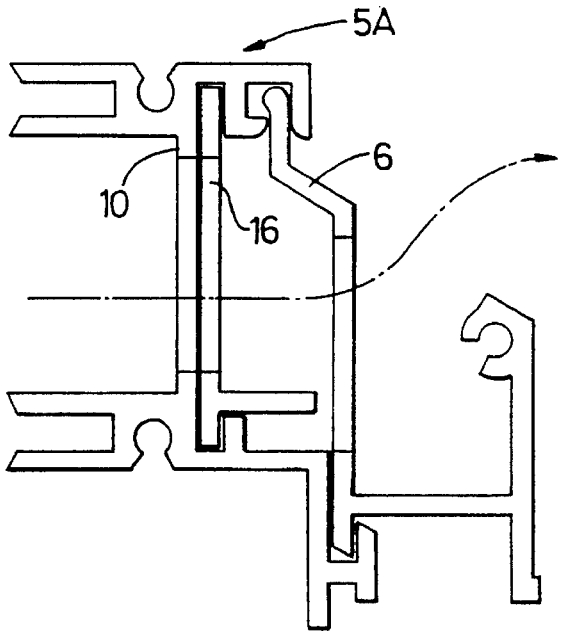
Figure 14B:
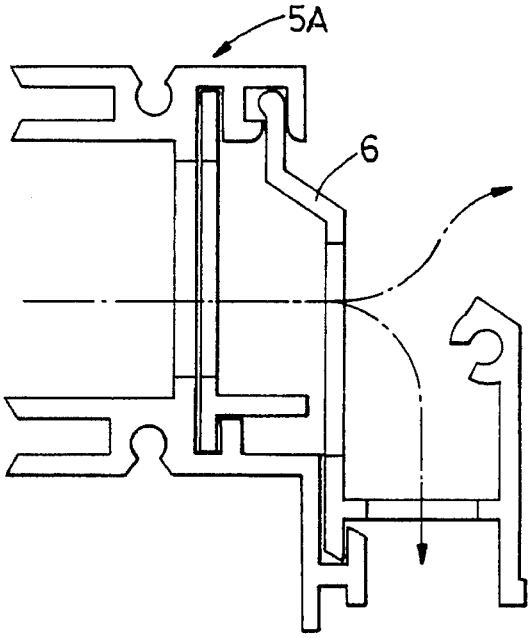
Figure 14C:
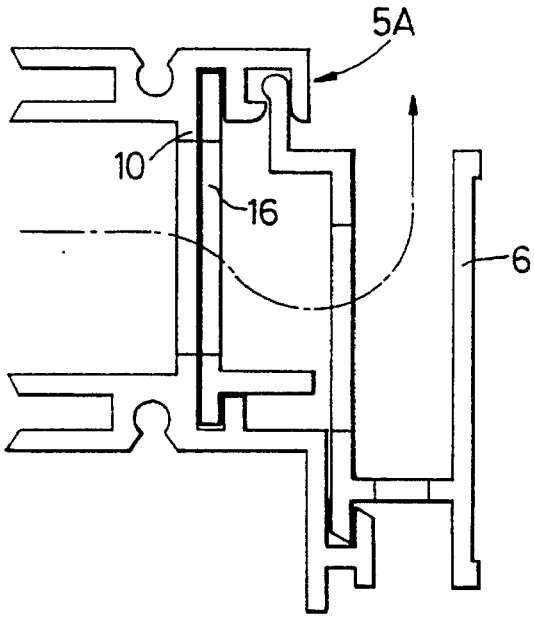
Figure 14D:
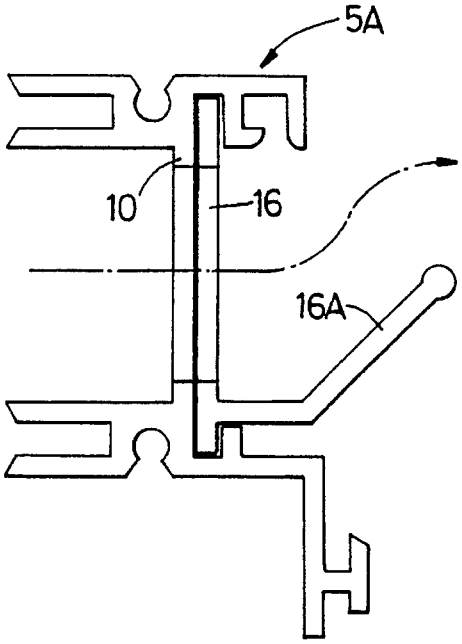
Figure 14E:
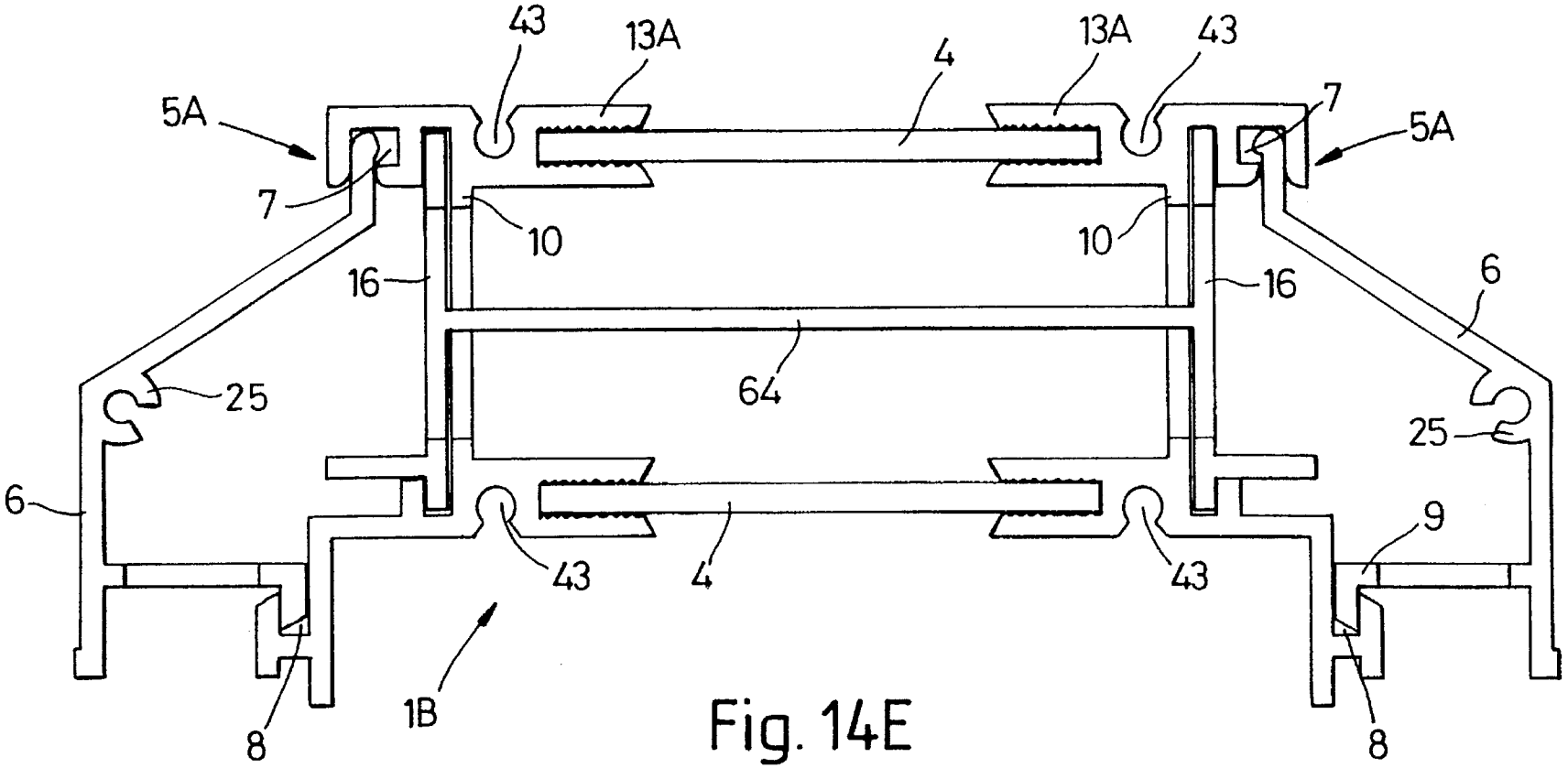

Again the weathering strips or canopies 6 are easily removable to facilitate canopy replacement or internal cleaning of the device. Different forms of canopy are of course possible and some examples are shown in FIGS. 14A–14C—these can provide air discharge flows of different directions, specifically upwards. One or both canopies 6 could be dispensed with, for certain applications. FIG. 14D shows such an example, wherein the slider plate 16 has an extended side portion 16A to facilitate operation of the air control. In FIG. 14E, a slider plate 16 is provided in both inlet and outlet portions 5A, and by providing a linking member 64, between she planes 16, the plates 16 can move in unison with only one cord control at one side being required. To enable movement to the fully closed and open positions, at least one of the wall portions bounding the apertures in plate 10 can be cut away appropriately to accommodate the requisite movements of the member 64. The double plates 16 improve the thermal qualities of the device as a quantity of air is trapped between the plate 16 in the closed position to constitute a thermal barrier.

I claim:

1. A ventilation device for location at the outer edge of a window frame so as to lie between the window frame and a surrounding building structure, said device including:

a main duct body comprising first and second side members each including a bottom part serving as support whereby said side members can rest on an outer edge of a window frame at respective corners thereof, each of said side members including an aperture means for through flow of ventilating air; and a pair of joining plates linking said side members and defining a duct for air flow between said aperture means of said side members, each of said side members including recess means to receive respective edges of said joining plates, said recess means of one side member facing said recess means of the other side member when said ventilation device is assembled for use.

2. A ventilation device as claimed in claim 1, wherein said fitting of said plates into said recess means of said first and second members form a unitary assembly with structural integrity.

3. A ventilation device as claimed in claim 1, wherein said plates comprise plain laminar plates.

4. A ventilation device as claimed in claim 1, wherein said first and second members comprise inlet and outlet portions which are substantially mirror images of each other.

5. A ventilation device as claimed in claim 1, wherein at least one of said first and second members includes releasable connecting means for attaching an additional fitment to said main duct body.

6. A ventilation device as claimed in claim 5, wherein said releasable connecting means comprise a male-female connection.

7. A ventilation device as claimed in claim 1, further comprising closure assemblies closing the ends of said main duct body.

8. A ventilation device as claimed in claim 7, wherein each of said closure assemblies comprises a pair of end plugs for fitting into said first and second side members and a lateral closure plate supported by said end plugs.

9. A ventilation device as claimed in claim 8, wherein the length of said lateral closure plate extending between said end plugs equals the width of each said joining plate linking said side members.

10. A ventilation device as claimed in claim 8, further comprising end caps provided for additional side fitments on said side member.

11. A ventilation device as claimed in claim 1, wherein each of said side members includes receiving means to receive a slider plate of an air flow control, and an apertured wall is provided in said side member adjacent said receiving means.

12. A ventilating device as claimed in claim 1, wherein each said side member includes a downstand wall for engagement with a side surface of a window frame.

13. A ventilation device as claimed in claim 1, wherein each said side member comprises a basic element constituted by an open form extrusion, said aperture means being subsequently cut in said basic element.

14. A ventilation device as claimed in claim 5, further comprising a weather canopy fitted to at least one side member by said releasable connecting means to shield said aperture means.

15. A ventilation device as claimed in claim 11, wherein each said side member includes a slider plate and connecting means to connect said slider plates for movement of said slider plates in unison.

16. A ventilation device as claimed in claim 1, wherein said recess means include internal serrations to facilitate securement of said joining plates in said recess means.

17. A ventilation device for location at the outer edge of a window frame so as to lie between the window frame and a surrounding building structure, said device comprising:

a main duct body comprising first and second side members each including a bottom part serving as a support whereby said side members rest on an outer edge of a window frame at respective corners thereof, each of said side members including an aperture means for through flow of ventilating air; and a pair of vertically spaced connecting means joining said side members so as to define a duct for air flow between said aperture means of said side members, each of said connecting means comprising a tongue carried by one said side member and a socket carried by the other said side member to receive said tongue, whereby said connecting devices provide for width variation of said ventilation device.

18. A ventilation device as claimed in claim 17, wherein at least one of said side members includes releasable connecting means for attaching an additional fitment to said main duct body.

19. A ventilation device as claimed in claim 8, wherein said releasable connecting means comprises a male-female connection.

20. A ventilation device as claimed in claim 17, wherein at least one of said side members includes receiving means to receive a slider plate of an air flow control, said at least one side member including an apertured wall adjacent said receiving means.

21. A ventilation device as claimed in claim 18, wherein recess means are provided on any of the top and bottom of said main duct body to receive fitting tongues of an associated fitment.

22. A ventilation device as claimed in claim 17, wherein said side members comprise basic elements constituted by open form extrusions, said aperture means being subsequently cut in said extrusions.

23. A ventilation device as claimed in claim 18, further comprising a weather canopy attached to at least one of said side members by said releasable connecting means to shield said aperture means of said side member.

24. A ventilation device as claimed in claim 17, wherein any one of said tongue and socket of each said connecting device carries serrations to facilitate securement of said tongue in said socket.

25. A ventilation device as claimed in claim 17, further comprising end caps closing the ends of said main duct body.

* * * * *

UNITED STATES PATENT AND TRADEMARK OFFICE

CERTIFICATE OF CORRECTION

PATENT NO. : 5,505,659

DATED : April 9, 1996

INVENTOR(S) : John George HAMILTON

It is certified that error appears in the above-identified patent and that said Letters Patent is hereby corrected as shown below:

Column 1: Line 2 - change "no" to --to--;
Line 3 - change "maim" to --main--;
Line 11 - change "=he" to --the--;
Line 15 - change "Comprises" to --comprises--;
Line 41 - change "Similar" to --similar--;

Line 57 - change "plane" to --plate--;
Line 63 - change "mis" to --mid--;

Column 2: Line 11 - change "or" to --for--;
Line 21 - change "i" to --I--;
Line 63 - change "pecludes" to --precludes--;

Column 3: Line 29 change "i" to --I--;
Line 51 - change "e" to --the--;
Line 54 - change "toted" to --noted--;
Line 55 - change "definin" to --defining--;

Column 4: Line 6 - change "pare" to --part--;
Line 13 - after "fitted" insert --at--.

Signed and Sealed this

Twelfth Day of August, 1997

Bruce Lehman

*Attest:*

BRUCE LEHMAN

*Attesting Officer*

*Commissioner of Patents and Trademarks*